US008578538B2

(12) United States Patent
Moore et al.

(10) Patent No.: US 8,578,538 B2
(45) Date of Patent: Nov. 12, 2013

(54) AUTOMATIC SWIMMING POOL CLEANERS AND BODIES, FEET, DISCS, AND OTHER COMPONENTS THEREOF

(75) Inventors: Michael Edward Moore, Westdene (ZA); Hendrikus Johannes Van Der Meijden, Midrand (ZA)

(73) Assignee: Zodiac Pool Care Europe (FR)

( * ) Notice: Subject to any disclaimer, the term of this patent is extended or adjusted under 35 U.S.C. 154(b) by 705 days.

(21) Appl. No.: 12/860,970

(22) Filed: Aug. 23, 2010

(65) Prior Publication Data

US 2010/0313363 A1 Dec. 16, 2010

Related U.S. Application Data

(62) Division of application No. 11/708,925, filed on Feb. 21, 2007, now Pat. No. 7,987,542.

(60) Provisional application No. 60/776,984, filed on Feb. 27, 2006.

(51) Int. Cl.
*E04H 4/00* (2006.01)

(52) U.S. Cl.
USPC ..... 15/1.7; 15/402

(58) Field of Classification Search
USPC ..... 15/1.7, 402, 404, 421; 134/18, 21, 134/22.11; 137/114, 527
See application file for complete search history.

(56) References Cited

U.S. PATENT DOCUMENTS

| | | | | |
|---|---|---|---|---|
| 4,351,077 | A | 9/1982 | Hofmann | |
| 4,642,833 | A | 2/1987 | Stoltz et al. | |
| 4,742,593 | A | 5/1988 | Kallenbach | |
| 5,337,433 | A | 8/1994 | Gould et al. | |
| 5,351,709 | A | 10/1994 | Vos | |
| 5,617,606 | A * | 4/1997 | Scott et al. | 15/246 |
| 5,852,841 | A | 12/1998 | Rissik | |
| 6,125,492 | A * | 10/2000 | Prowse | 15/1.7 |
| 6,248,232 | B1 * | 6/2001 | Stoner | 210/136 |
| 6,412,133 | B1 | 7/2002 | Erlich et al. | |
| 6,820,297 | B2 | 11/2004 | Phillipson et al. | |
| 6,834,410 | B2 | 12/2004 | Phillipson et al. | |
| 7,159,263 | B2 | 1/2007 | Sebor | |
| 7,284,565 | B2 | 10/2007 | Sebor et al. | |

(Continued)

FOREIGN PATENT DOCUMENTS

| | | |
|---|---|---|
| WO | WO 0201022 | 1/2002 |
| WO | WO 2007098192 A3 | 8/2007 |
| ZA | 877967 | 10/1987 |

OTHER PUBLICATIONS

International Search Report and Written Opinion dated Feb. 21, 2008 in related PCT/US2007/004495.
International Preliminary Examination Report dated Sep. 12, 2008 in related PCT/US2007/004495.
Office Action dated Oct. 14, 2010 in parent U.S. Appl. No. 11/708,925.

(Continued)

*Primary Examiner* — Lee D Wilson

(57) ABSTRACT

Devices for cleaning vessels, especially swimming pools, are discussed. The devices may include repositionable in-line valves, with the valves typically moving laterally (from side to side) and changing the initial direction of the main fluid-flow path through the valves and corresponding cleaner bodies. Asymmetric feet may be utilized as part of the devices, whose bottom bearing surfaces may include elongated strips of material placed parallel to the normally-forward direction of travel of the devices. Discs of non-uniform flexibility also may be employed, and blocking tabs or gripping material may be used to inhibit undesired backward movement of a cleaner when its operation commences.

25 Claims, 18 Drawing Sheets

(56) References Cited

U.S. PATENT DOCUMENTS

| | | | | |
|---|---|---|---|---|
| 7,987,542 | B2 * | 8/2011 | Moore et al. | 15/1.7 |
| 8,312,583 | B2 * | 11/2012 | Van Der Meijden et al. | 15/1.7 |
| 2002/0002750 | A1 | 1/2002 | Phillipson et al. | |
| 2002/0116772 | A1 | 8/2002 | Phillipson et al. | |
| 2002/0166185 | A1 * | 11/2002 | Balint | 15/1.7 |
| 2002/0170129 | A1 | 11/2002 | Veloskey et al. | |
| 2004/0181884 | A1 * | 9/2004 | Phillipson et al. | 15/1.7 |
| 2006/0032539 | A1 | 2/2006 | Meijden et al. | |
| 2007/0256257 | A1 * | 11/2007 | Phillipson et al. | 15/1.7 |
| 2007/0261183 | A1 * | 11/2007 | Moore et al. | 15/1.7 |
| 2008/0256727 | A1 * | 10/2008 | Van Der Meijden et al. | 15/1.7 |

OTHER PUBLICATIONS

Office Action dated Jul. 14, 2010 in parent U.S. Appl. No. 11/708,925.
Office Action dated Jun. 15, 2010 in parent U.S. Appl. No. 11/708,925.
Office Action dated Jun. 11, 2009 in parent U.S. Appl. No. 11/708,925.
Response dated Jul. 17, 2009 in U.S. Appl. No. 11/708,925.
Response dated Aug. 3, 2010 in U.S. Appl. No. 11/708,925.
Response dated Nov. 5, 2010 in U.S. Appl. No. 11/708,925.
Office Action dated Jan. 12, 2011 in U.S. Appl. No. 11/708,925.
Notice of Allowance dated Mar. 28, 2011 in U.S. Appl. No. 11/708,925.

* cited by examiner

AUTOMATIC SWIMMING POOL CLEANERS AND BODIES, FEET, DISCS, AND OTHER COMPONENTS THEREOF

CROSS REFERENCE TO RELATED APPLICATION

This application is a divisional application of U.S. Ser. No. 11/708,925 filed on Feb. 21, 2007, now pending, which claims the benefit of U.S. Provisional Application No. 60/776,984 filed on Feb. 27, 2006, the contents of both of which are incorporated herein by reference.

FIELD OF THE INVENTION

This invention relates to devices for cleaning fluid-containing vessels and more particularly, but not exclusively, to automatic cleaners for swimming pools and components of such cleaners including, but not limited to, bodies, feet, and discs.

BACKGROUND OF THE INVENTION

Commonly-owned U.S. Pat. No. 4,642,833 to Stoltz, et al. (the "Stoltz Patent") discloses various valve assemblies useful for automatic swimming pool cleaners. These assemblies typically include flexible, tubular diaphragms surrounded by chambers, with the diaphragms interposed in the fluid-flow paths (i.e. "in-line") through the cleaners. In response to variation in pressure internally and externally, the diaphragms contract and expand transversely along at least part of their lengths, thereby controlling fluid flow therethrough.

Commonly-owned U.S. Pat. No. 4,742,593 to Kallenbach (the "Kallenbach Patent") discloses additional valve assemblies for use with automatic swimming pool cleaners. These assemblies, also typically tubular and of flexible material, too may be interposed in-line, within the fluid-flow paths of such cleaners. According to the Kallenbach Patent:

> The body [of the tubular valve] has an intermediate section between the ends that assumes a substantially collapsed condition over a segment thereof in absence of a pressure differential between the interior and exterior.

The section preferably is collapsed transversely over a segment. See Kallenbach Patent, col. 1, 11. 28-32.

International Publication No. WO 02/01022 of Kallenbach, et al. (the "Kallenbach Publication"), entitled "Swimming Pool Cleaner," details another cleaner in which a valve periodically interrupts a flow of water through the body of the cleaner. Included in the cleaner are a main flow path and a by-pass passage built into the body. See Kallenbach Publication, p. 5, 11. 8-11. Also included in one version is an "annular resilient rolling diaphragm" with an edge "located in sealing engagement with the inner wall of the body." Id., p. 6, 11. 24-26. However, a dome-shaped valve closure member, rather than the rolling diaphragm, operates to interrupt fluid flow through the main path. Additionally, neither the rolling diaphragm nor the dome-shaped member is interposed in-line in the main water path from the inlet passage of the cleaner to the outlet of the body.

U.S. Pat. No. 4,351,077 to Hofmann (the "Hofmann Patent") describes yet another cleaning apparatus in which a valve interrupts fluid flow through the cleaner body. This valve, denoted a "flapper," oscillates so as periodically to open and close the flow passage through the body. See Hofmann Patent, col. 2., 1. 67 through col. 3, 1. 2. Opposite the flow passage within the body is a so-called "suction communication," which is closed when the flow passage is open and opens briefly when the flow passage is closed. See id., col. 3, 11. 9-22.

Each of the Stoltz, Kallenbach, and Hofmann Patents and the Kallenbach Publication discusses "suction-side" cleaners in which a pair of concentric pipes exist, the outer of the pipes being adapted for connection to a flexible hose leading (directly or indirectly) to the inlet, or "suction side," of a pump. An annular gap between the pipes permits water to flow through the by-pass passage of the cleaner of the Kallenbach Publication toward the flexible hose. A similar gap in versions of cleaners discussed in the Stoltz and Kallenbach Patents offers "suction communication . . . through slots [in a plate] to [a] chamber" defined at least in part by the tubular members of these patents. The contents of the Kallenbach Publication, together with those of the Stoltz, Kallenbach, and Hofmann Patents, are incorporated herein in their entireties by this reference.

SUMMARY OF THE INVENTION

The present invention provides alternatives to the devices addressed in these earlier efforts, particularly (but not necessarily exclusively) those involving diaphragm valves. Included among features of the present invention are an in-line valve assembly that is periodically repositioned, typically laterally (i.e. from side-to-side) relative to the surface to be cleaned, effectively changing the initial direction of the main fluid-flow path through the cleaner body. Also included as part of the invention is a sealing mechanism that seals against the to-be-cleaned surface on the side of the valve assembly opposite the one toward which the valve is positioned at any given time.

Additionally, the present invention may incorporate novel apron and foot structure. Unlike conventional aprons and associated footpads, which have circular cross-section, aprons of the invention may be truncated in the normally-forward direction of travel and extend principally transversely beneath the cleaner body. These aprons thus may be wider than they are long, allowing their associated cleaner bodies to approach pool corners more closely before the cleaner discs lose suction with the pool floors. Bearing surfaces of the feet, moreover, may constitute elongated strips of material placed parallel to the normally-forward direction of travel of the cleaners, reducing the likelihood of their engaging obstructions in the pools.

Discs of the present invention may lack uniform flexibility. Instead, the discs may be least flexible toward the front of the cleaner bodies, reducing the risk of the cleaners sticking in a corner of a pool. Greater flexibility may exist in other areas for improved sealing to the to-be-cleaned surface. Flexibility in the rear part of the discs additionally may improve the ability of cleaners to climb pool walls.

Innovative discs also may include fins in the forward sections to facilitate movement over obstacles encountered in use. As well, "blocking" tabs may be attached to the discs or barbed, "gripper" material may be placed underneath the finned sections if appropriate. Such tabs or material, in particular, may inhibit undesired backward movement of a cleaner when its operation commences.

It thus is an optional, non-exclusive object of the present invention to provide alternative automatic swimming pool cleaners and components thereof.

It also is an optional, non-exclusive object of the present invention to provide in-line valve assemblies for automatic swimming pool cleaners whose position may change in use.

It is a further optional, non-exclusive object of the present invention to provide repositionable valve assemblies for suction-side automatic pool cleaners.

It additionally is an optional, non-exclusive object of the present invention to provide sealing mechanisms that seal against a surface on the side of the valve assembly opposite the one toward which the valve is positioned at any given time.

It is, moreover, an optional, non-exclusive object of the present invention to provide aprons and feet (footpads) with non-circular cross-sections.

It is yet another optional, non-exclusive object of the present invention to provide feet that are truncated in the normally-forward direction of travel of associated cleaners and extend principally transversely beneath the cleaner bodies.

It is an additional optional, non-exclusive object of the present invention to provide bearing surfaces that are placed parallel to the normally-forward travel direction.

It is also an optional, non-exclusive object of the present invention to provide discs with non-uniform flexibility for use with automatic swimming pool cleaners.

It is a further optional, non-exclusive object of the present invention to provide "blocking" tabs attached to the disc or barbed, "gripper" material underneath sections of the disc to inhibit undesired backward movement of a cleaner when it commences operation.

Other objects, features, and advantages will be apparent to those skilled in the art with reference to the remaining text and the drawings of this application.

DETAILED DESCRIPTION

Figure 5:
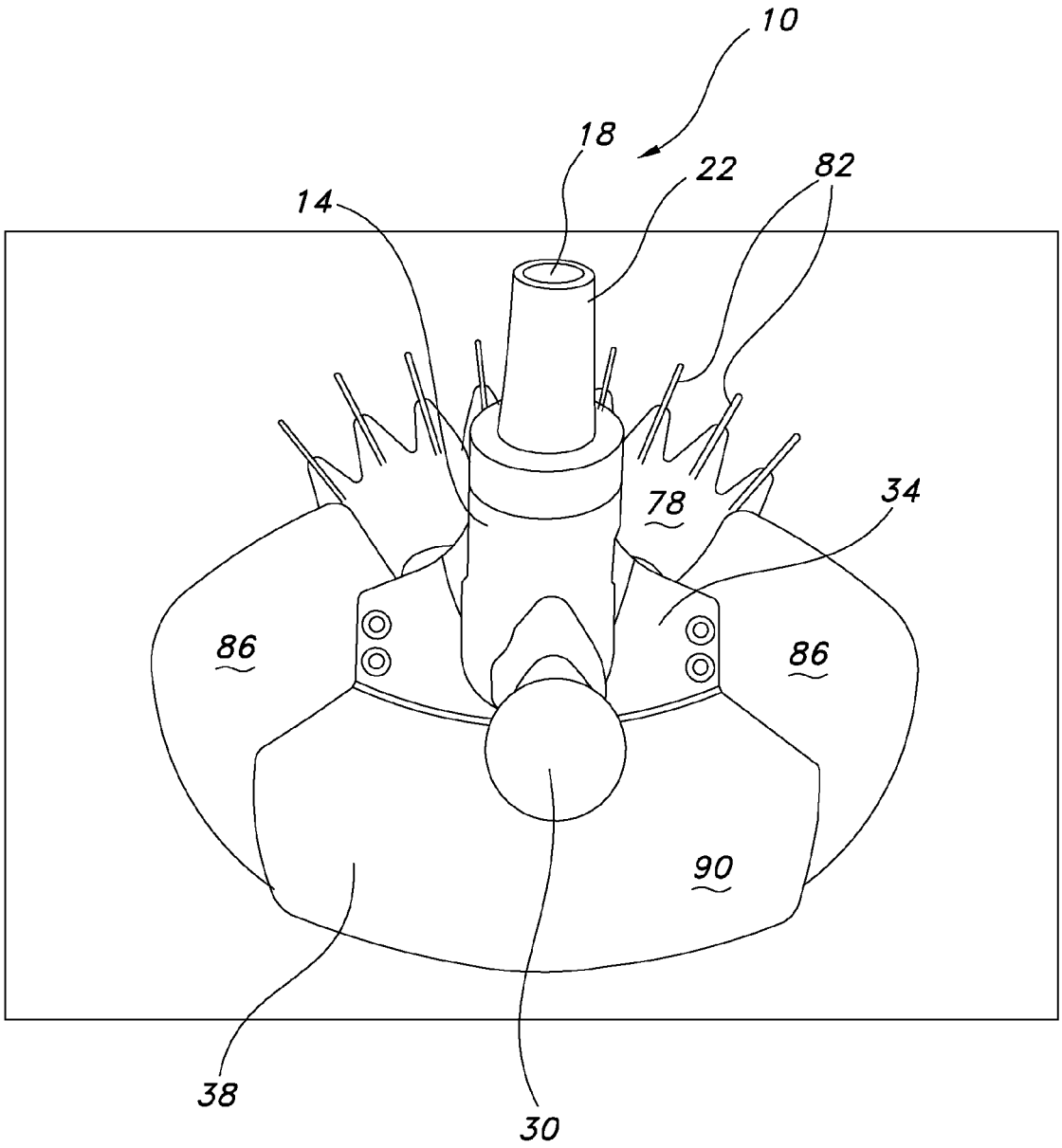
FIG. 5 is a generally bird's-eye view of the automatic swimming pool cleaner of FIGS. 1-4.
Figure 6:
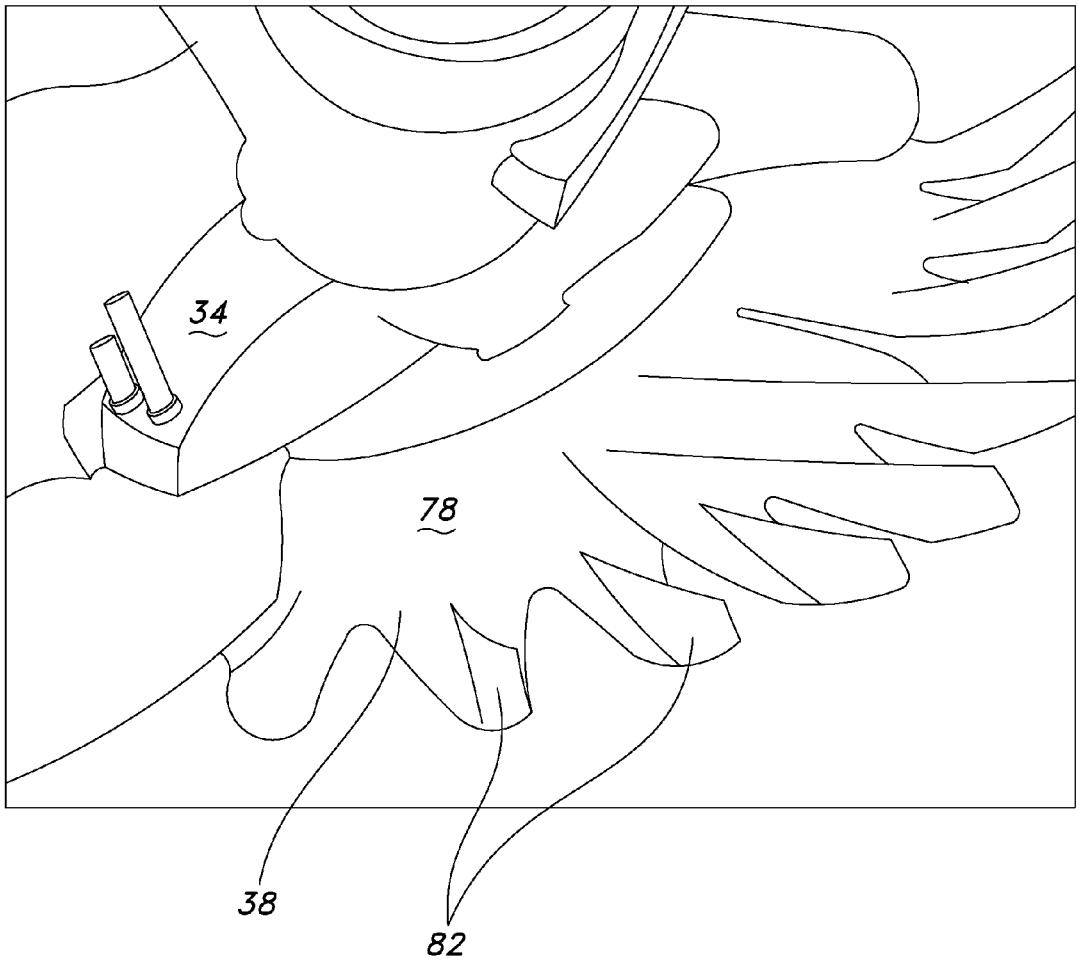
FIG. 6 illustrates aspects of an exemplary apron of the automatic swimming pool cleaner of FIGS. 1-4.
Figure 7:
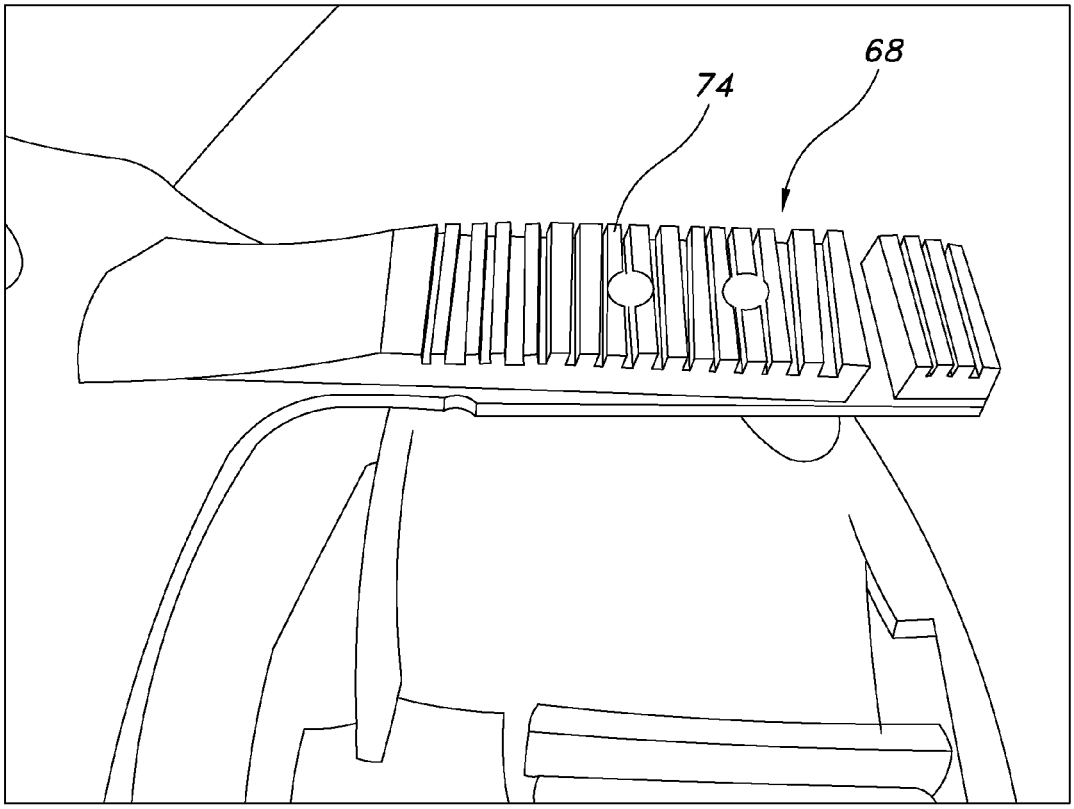
FIG. 7 illustrates an exemplary bearing surface of a footpad of the present invention.
Figure 8:
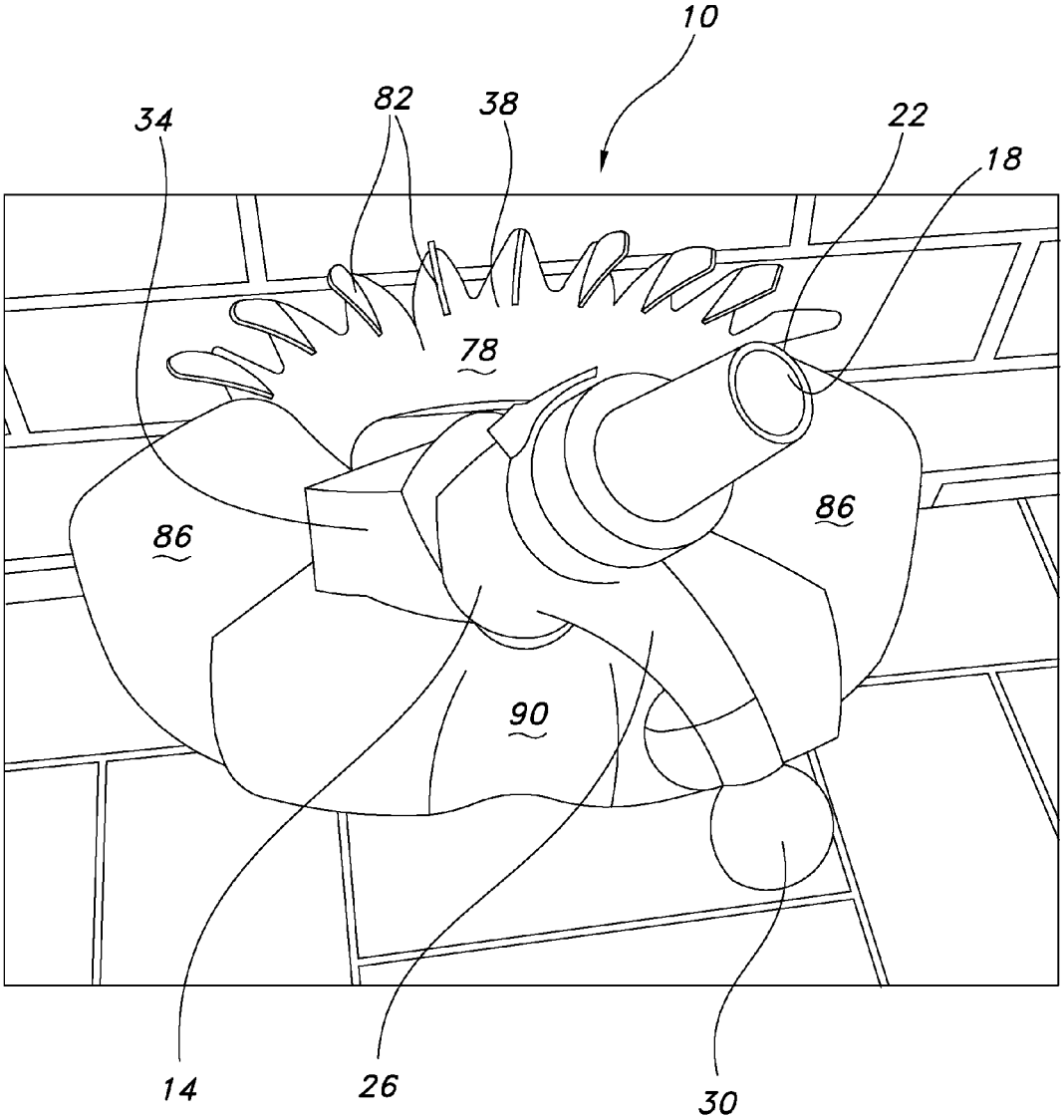
FIG. 8 is a perspective view of the automatic swimming pool cleaner of FIGS. 1-4 illustrating the act of transitioning from a horizontal surface to a vertical surface of movement.

Well depicted in FIGS. 5 and 8 is an exemplary automatic swimming pool cleaner 10 of the present invention. Cleaner 10 is designed primary for attachment to the inlet, or suction side, of a pump of a swimming pool filtration system. Some or all aspects of the present invention are not necessarily limited to use with suction-side automatic swimming pool cleaners, however, and conceivably could be employed as part of other devices as well.

Shown in FIGS. 5 and 8 as part of cleaner 10 are body 14, inner pipe 18, and outer pipe 22. Similar to those of the cleaner described in the Kallenbach patent, inner and outer pipes 18 and 22 of cleaner 10 may be concentric, with outer pipe 22 adapted to be connected to a flexible hose leading, ultimately, to the inlet of a pump. Extending from body 14 may be arm 26, whose end 30 may contain a weight (not shown) functioning, in part, to balance a float (also not shown) typically positioned within body 14. However any weight need not necessarily be placed within end 30, and indeed need not necessarily be positioned at any point within arm 26. In use, arm 26 also may function as a bumper or bearing surface in certain situations.

Also illustrated in FIGS. 5 and 8 as part of cleaner 10 are apron 34 and disc 38. Apron 34 may be connected directly or indirectly to footpads 68, each of which may provide a bearing surface as cleaner 10 traverses a vessel; apron 34 may also serve as an interface connecting disc 38 to body 14. Although disc 38 too functions, to modest extent, as a bearing surface, it also operates to effect sealing of certain surfaces as body 10 is evacuated by the pump.

FIGS. 1-4 detail aspects of (nominal) underside 42 of body 14. Visible in underside 42 is inlet 46, through which debris-laden water or other fluid may flow into cleaner 10. In normal use, inlet 46 is adjacent a to-be-cleaned pool surface. Also illustrated in FIGS. 1-4 within inlet 46 is inlet end 50 of valve 54, through which the debris-laded fluid passes before travelling through inner pipe 18 to the flexible hose and, from there, to some type of filter.

Valve 54 accordingly is "in-line," in that it forms part of this main fluid-flow path through body 14. Any suitable valving mechanism may be employed as valve 54. Preferably, however, valve 54 is of the diaphragm type, as depicted in the Kallenbach patent or in either of co-pending U.S. patent application Ser. Nos. 10/917,587 and 10/939,579, whose contents also are incorporated herein in their entireties by this reference.

Existing diaphragm-valve assemblies fix the position of the valve relative to the remainder of the main fluid-flow path during operation. Valve 54, by contrast, is designed to move periodically, effectively cyclically reorienting a portion of the main fluid-flow path through body 14. Consequently, rather than maintaining inlet end 50 of valve 54 generally co-linear with the main direction of travel of the cleaner 10, valve assembly 58 of the present invention periodically repositions inlet end 50 relative to such main travel direction. Presently preferred versions of valve assembly 58 reposition inlet end 50 from side-to-side of such main travel direction, although other motions with lateral components should be substituted instead as beneficial or desired. Further, assembly 58 conceivably periodically could reposition inlet end 50 solely along the main direction of travel (i.e. with no lateral component of motion), although applicants do not currently consider this approach to be especially advantageous.

Figure 11:
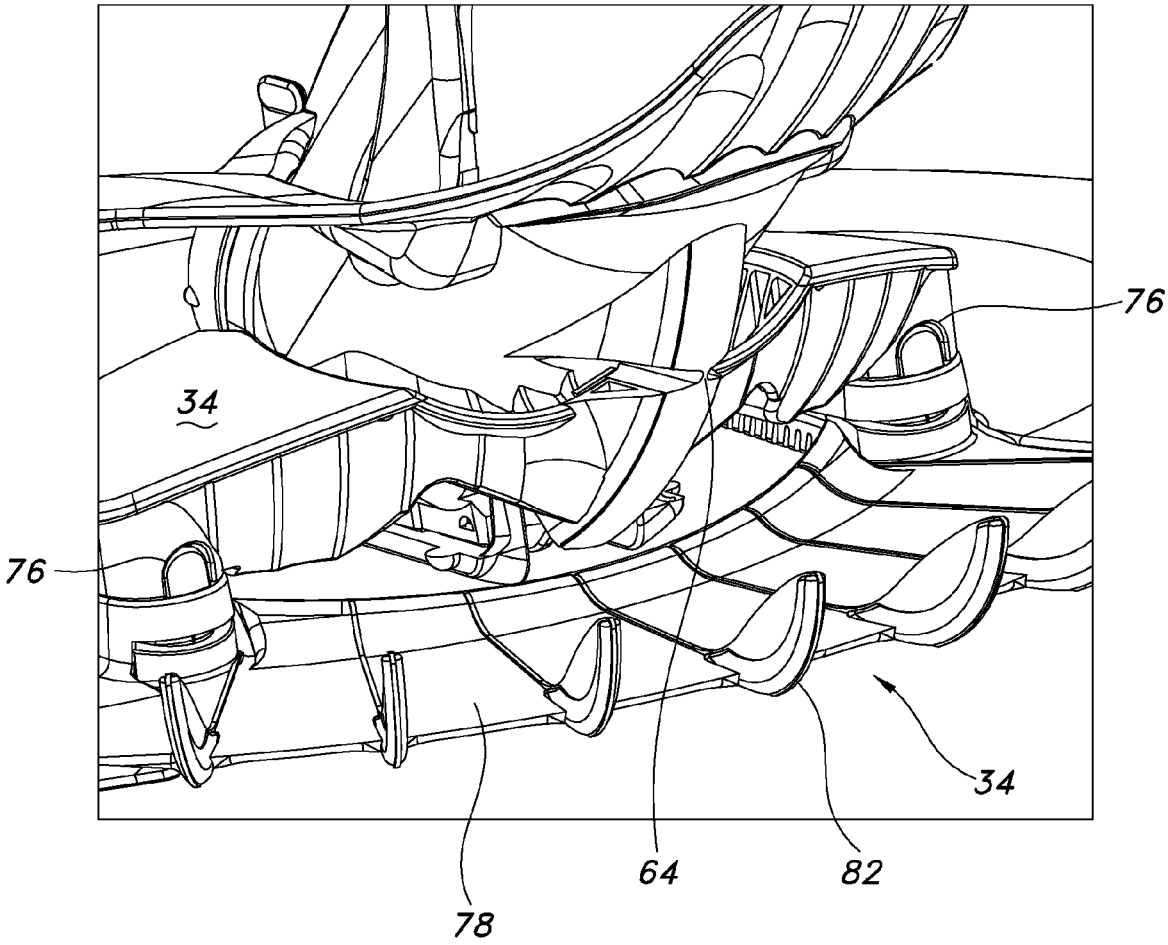
Figure 12:
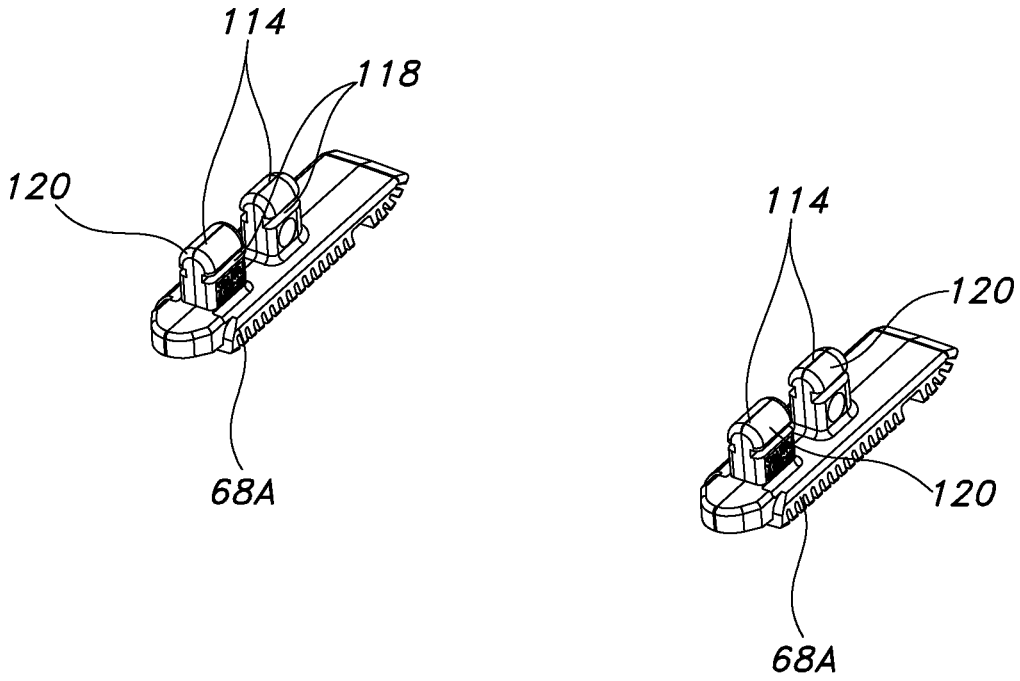

Valve assembly 58 may comprise a housing 62 for valve 54 adapted to pivot within inlet 46. Any suitable mechanism may be employed to effect such pivoting of housing 62, as long as the mechanism permits continued fluid communication (directly or indirectly) from valve 54 to inner pipe 18. One or more hinges 64 (FIG. 11) may also be employed to facilitate the pivoting. Each hinge 64 preferably is a one-piece "living" or similar hinge made of flexible material.

Figure 1:
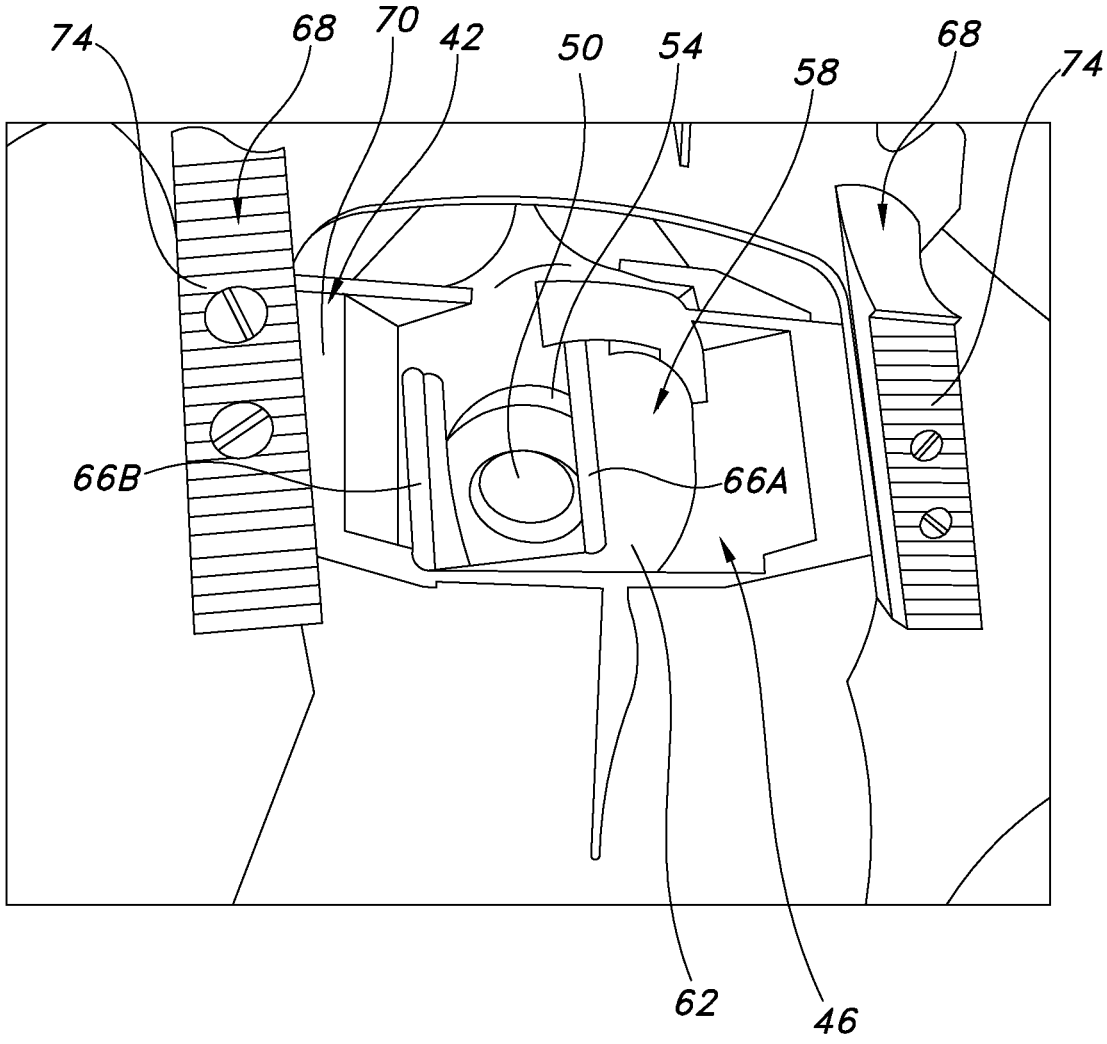
FIGS. 1-4 illustrate portions of an automatic swimming pool cleaner of the present invention containing an exemplary valve assembly and sealing mechanism.
Figure 2:
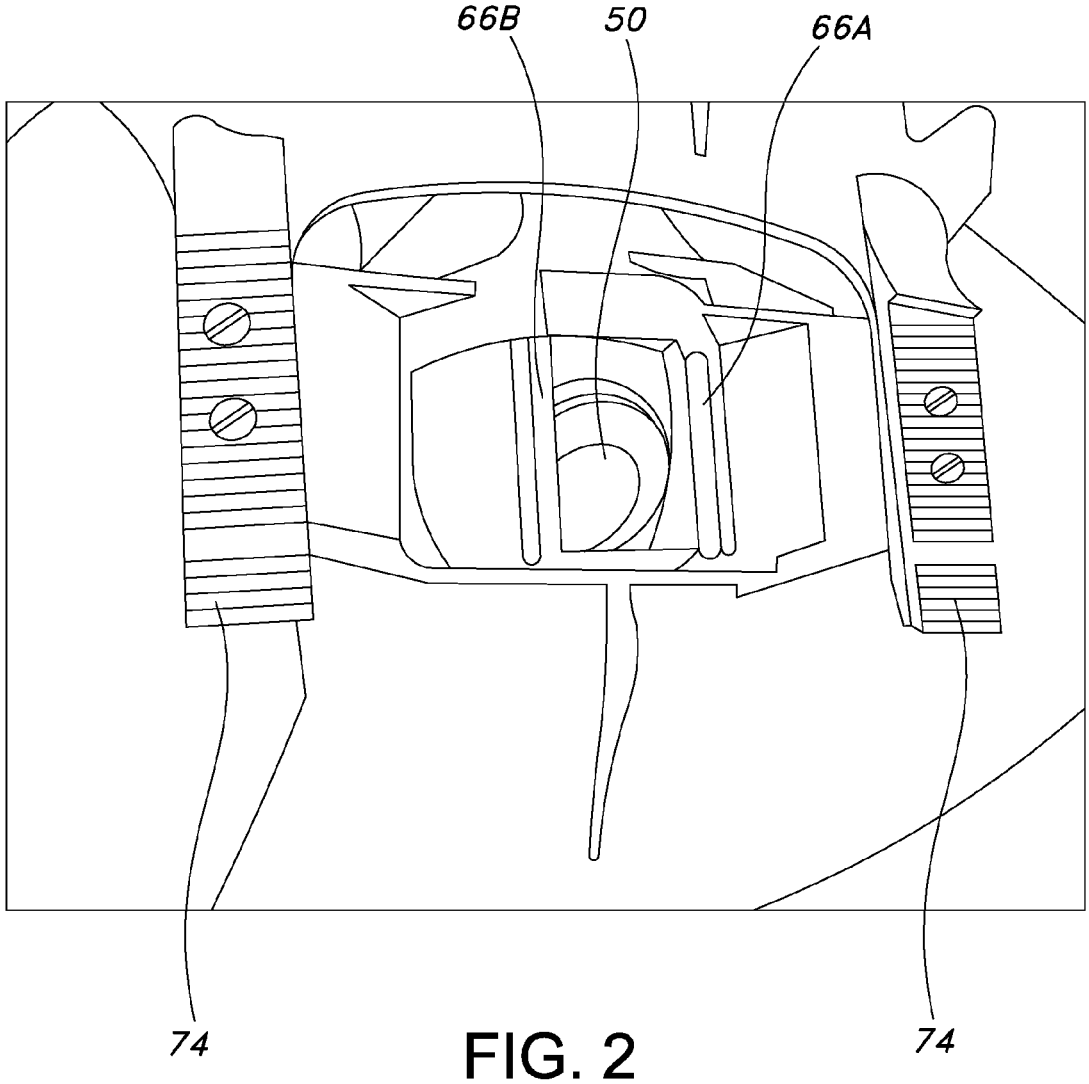
Figure 3:
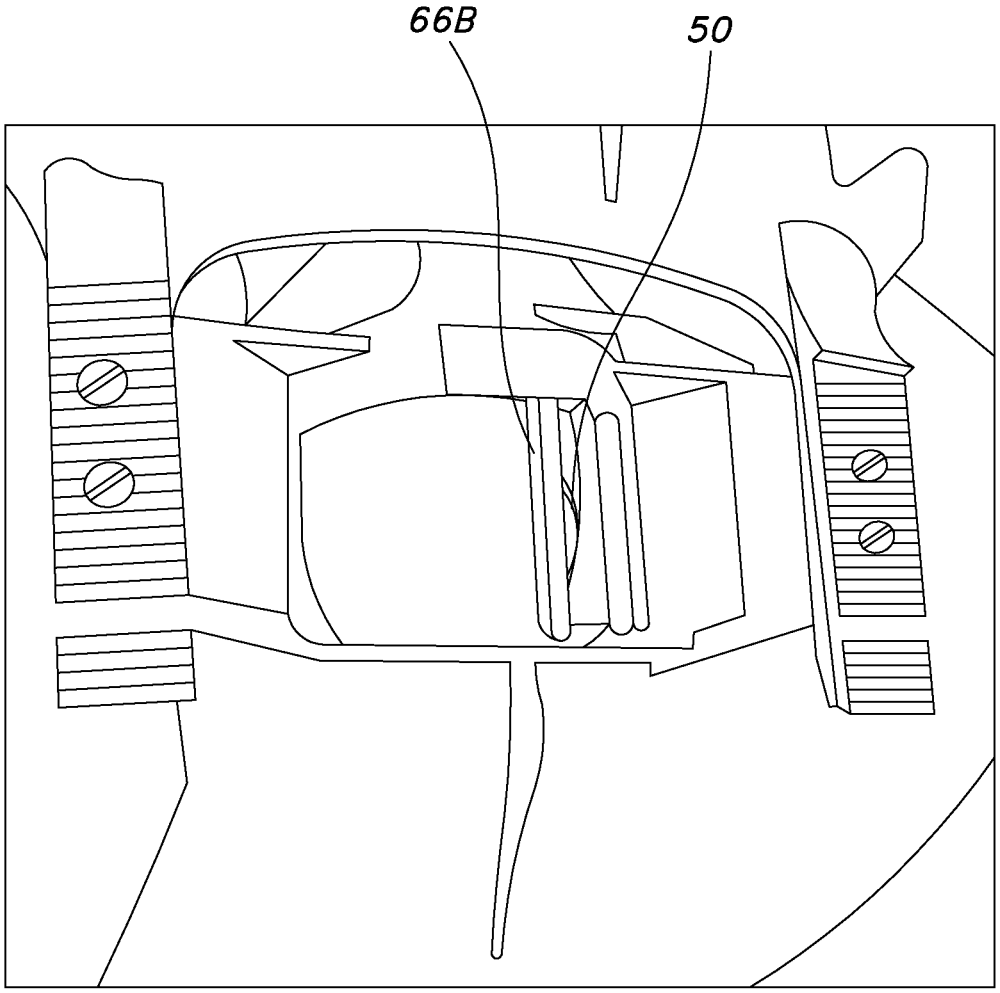
Figure 4:
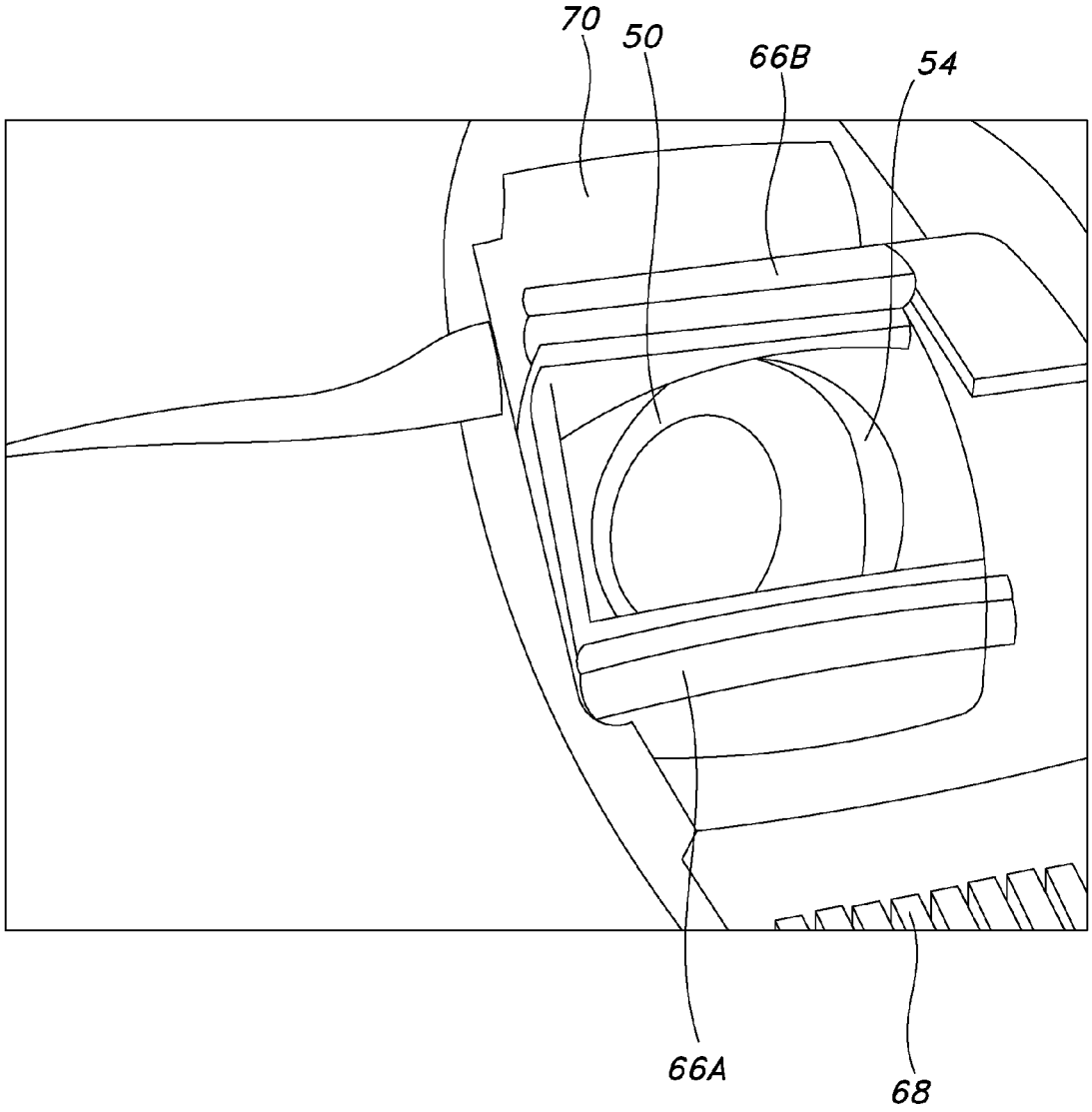

Pivoting of housing 62 is shown in FIGS. 1-3, which illustrate differing positions of housing 62 and inlet end 50 of valve 54. FIG. 2, for example, depicts inlet end 50 positioned generally co-linear with the main direction of travel of cleaner 10. FIG. 1, by contrast, depicts inlet end 50 positioned to one side of such main travel direction, while FIG. 3 details inlet end 50 positioned to the other side of such main direction. In certain preferred versions of cleaner 10, housing 62 pivots through approximately seventy degrees, thirty-five degrees to each side of the main travel direction.

Generally, inlet end 50 sweeps rapidly from side to side as cleaner 10 travels in a nominal direction. FIGS. 1-3 thus provide snapshots of varying positions of valve 54 as a function of time. Assuming, for example, that FIG. 2 depicts a default, resting position of valve 54 and housing 62, FIG. 1 might then indicate a subsequent position of valve 54. Thereafter, valve 54 would return to the position depicted in FIG. 2 before travelling to the position of FIG. 3, followed by a return to the position of FIG. 2 and then on to the position of FIG. 1. This cycle of repositioning preferably continues while cleaner 10 is operational, as applicants believe it produces better cleaning results. Nevertheless, if appropriate or desired, cleaner 10 possibly could include a mechanism that could temporarily fix the position of valve 50 along the main direction of travel of cleaner 10, as shown in FIG. 2.

Assembly 58 additionally may comprise one or more sealing surfaces attached to housing 62. Two such surfaces 66A and 66B are depicted in FIGS. 1-3, with the surfaces being generally parallel to and generally symmetric about the main direction of travel of cleaner 10 when valve 54 is in the position shown in FIG. 2. When valve 54 is in the position shown in FIG. 1, surface 66B may abut and seal against the surface to be cleaned. Conversely, when valve 54 is positioned as shown in FIG. 3, surface 66A may abut and seat against the surface to be cleaned.

In use, valve assembly 58 functions to counteract existing tendencies of flexible hoses to steer, or otherwise influence the movement direction of, the cleaners to which they are attached. If a hose pulls an attached cleaner to the right of a nominal path, for example, housing 62 will pivot so as to point inlet end 50 of valve 54 to the left of the nominal path. Doing so provides more suction power left of the path, effectively counteracting the influence of the hose. Similarly, if the hose pulls cleaner 10 to the left of the nominal path, housing 62 will pivot so as to direct the suction power of valve 54 to the right of the path. In this manner, the position of valve 54 continually conflicts with the movement influence provided by the flexible hose, thereby lessening the effect of such influence.

Illustrated in various of FIGS. 1-8 is apron 34, to which one or more footpads 68 may connect. Conventional aprons, which are generally annular in shape, thus have substantially equal lengths and widths. By contrast, apron 34 is substantially wider than it is long. This configuration allows body 14 to be closer to a corner or other transition of a pool before sealing against the pool surface via disc 38 is lost. Consequently, apron 34 facilitates cleaner 10 originating its climbing of vertical surfaces of pools.

Underside 70 of apron 34 surrounds housing 62 and valve 54. Underside 70 additionally may be connected to footpads 68, each of which includes a bearing surface 74. Preferred versions of surfaces 74 are elongated strips of serrated plastic material placed parallel to the normally-forward direction of travel of the cleaners, reducing the likelihood of their engaging obstructions in the pools. Again preferably (albeit not necessarily), two such surfaces 74 are included as part of two footpads 68 positioned symmetrically about the main travel direction of cleaner 10. Surfaces 74 may be separate strips of material attached to underside 70 of apron 34 using screws (as shown in FIGS. 1-3) or other fasteners; alternatively, they may be molded or otherwise integrally formed as part of apron 34. Yet alternatively, footpads 68 (together with portions of disc 38) may be fitted into channels 76 of a channelled version of apron 34 (see FIG. 11).

Aspects of disc 38 are detailed principally in FIGS. 5 and 8. Disc 38 may be formed of moldable plastic or other material. Preferably, however, disc 38 lacks uniform flexibility. Instead, disc 38 has lesser flexibility forward of body 14 and greater flexibility elsewhere.

As depicted in FIGS. 5 and 8, forward section 78 of disc 38 may, but need not necessarily, constitute an arc-shaped segment of material similar to that described in U.S. Pat. No. 5,421,054 to Dawson, et al., whose contents also are incorporated herein in their entirety by this reference. As initially noted therein, fins 82 may extend radially upward from and outward of a serpentine periphery 82, with the fins 82 providing sufficient rigidity to disc 38 to enable it to ride over various objects, including many drains, lights, valves, and other nozzles, projecting from internal surfaces of pools. Enhanced rigidity of forward section 78 additionally inhibits its assuming the shape or a corner or other transition within a pool (and thereby sticking in the corner or at the transition) and prevents forward section 78 from folding under itself when departing from vertical surfaces such as walls.

Connected to any, some, or all of forward section 78, apron 34, footpad 68, or body 14 are mid-section 86 and rear section 90 of disc 38. Contrasted with forward section 78, mid-section 86 and rear section 90 are more flexible, as they rarely function as the leading edge of cleaner 10. This greater flexibility provides improved sealing of disc 38 to the surface to be cleaned. Flexibility of rear section 90 additionally may improve the ability of cleaner 10 to climb pool walls by permitting body 14 to rotate rearward some as generally illustrated in FIG. 8.

Figure 9:
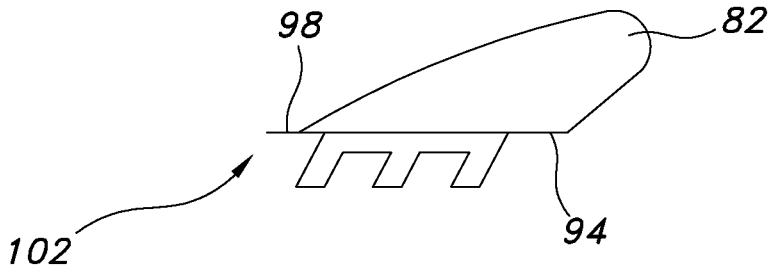
FIG. 9 illustrates, somewhat schematically, barbed gripping material attached to the underside of portions of a disc of the present invention.

Because of float placement within some versions of cleaners 10, the center of gravity of such cleaners 10 is forward of fins 82. Consequently, when a swimming pool pump is inactive, inner and outer pipes 18 and 22 tend to rest at a low angle to the horizontal, effectively causing cleaner 10 to "lie down." When the pump is activated, cleaner 10 may attempt to travel backward, undesirably, rather than forward. Accordingly, undersides 94 of tongues 98 from which fins 82 protrude may include barbed gripping material 102 as shown in FIG. 9. Such material is configured to inhibit backward movement of cleaner 10 in these circumstances, thereby encouraging desired forward movement thereof.

Figure 10:
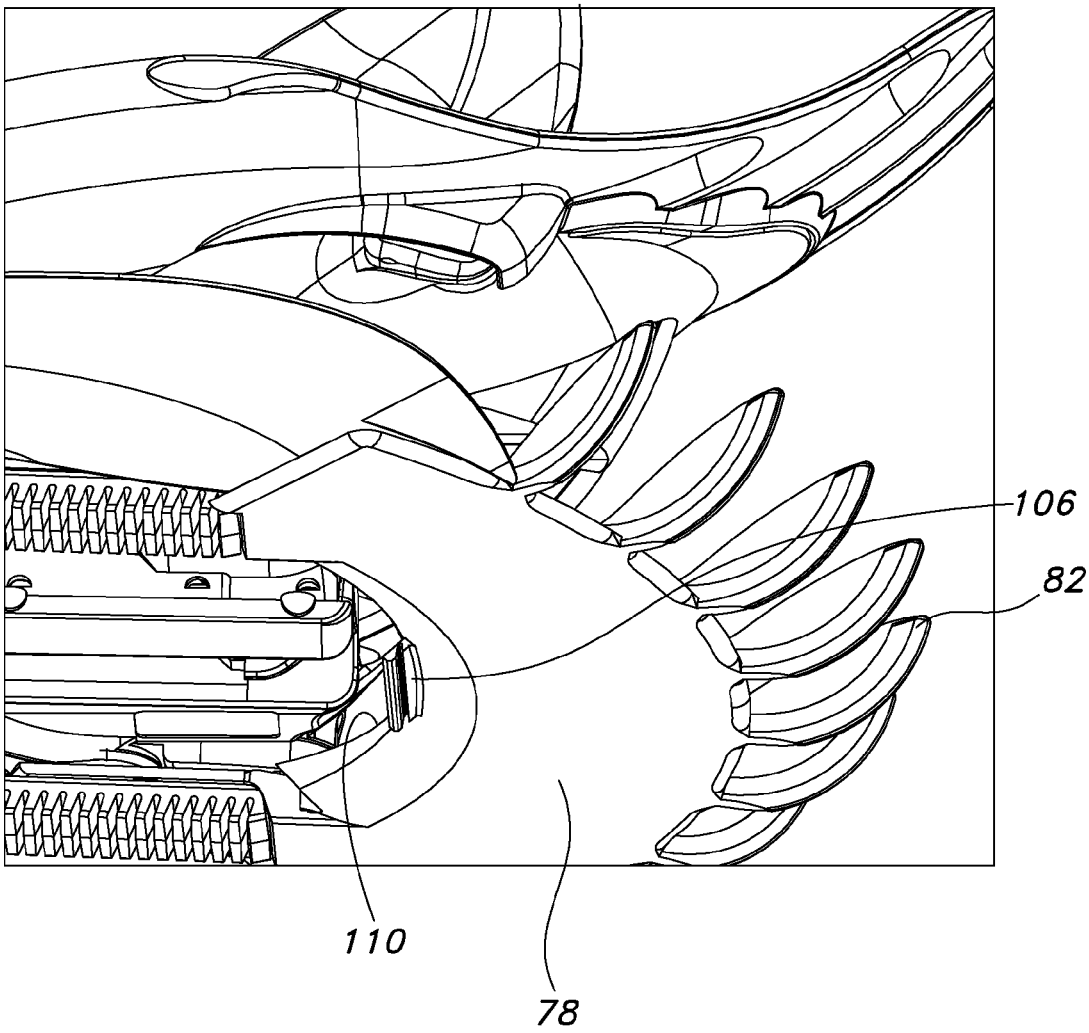
FIGS. 10-18 show aspects of an alternate automatic swimming pool cleaner of the present invention.

Alternatively or additionally, one or more tabs 106 may be attached to or integrally formed with forward section 78 of disc 38. Shown in FIG. 10, an exemplary tab 106 is adapted to lie flat when cleaner 10 is moving forward so as not to impede such movement. However, should cleaner 10 attempt to travel backward in use, tab 106 will contact (catch) the floor of the pool, in turn forcing forward section 78 upward. As forward section 78 moves upward, rear section 90 will be forced downward, allowing it to adhere to the pool surface temporarily and cease the backward movement. One tab 106 preferably is positioned at rear edge 110 of forward section 78 (opposite fins 82), although more tabs 106 may be used and positioned otherwise as needed.

Figure 13:
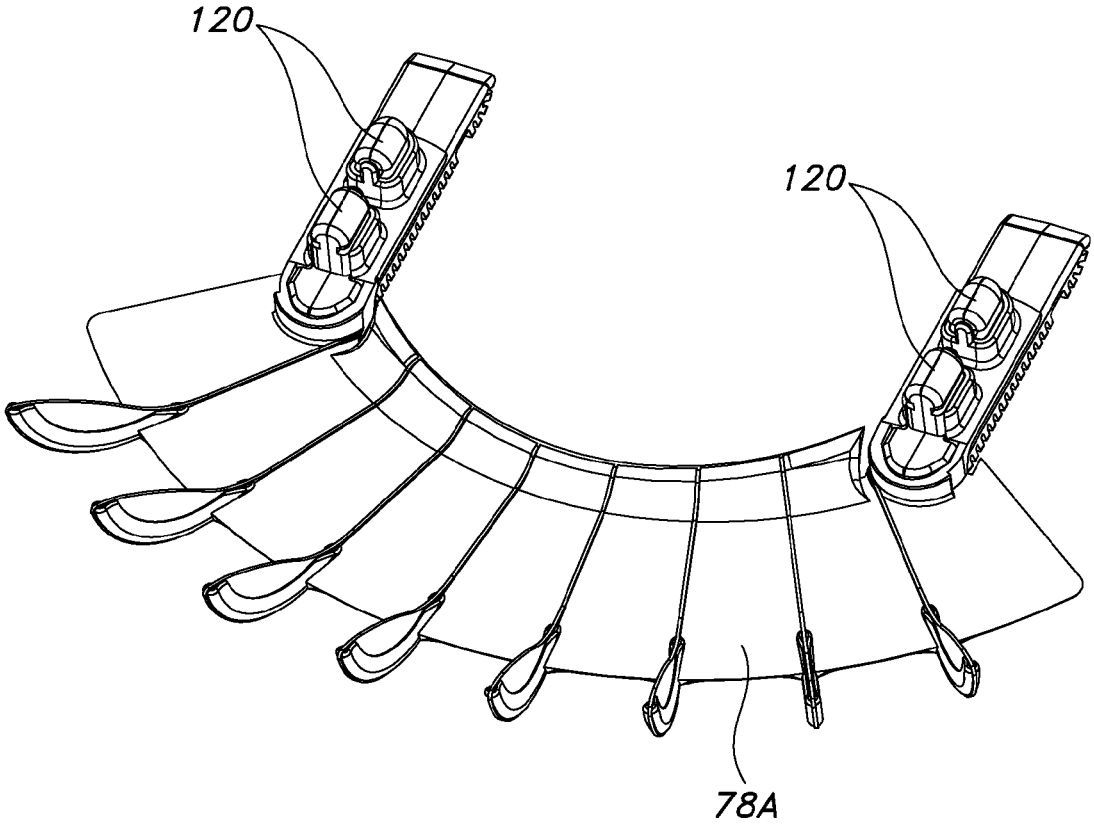
Figure 14:
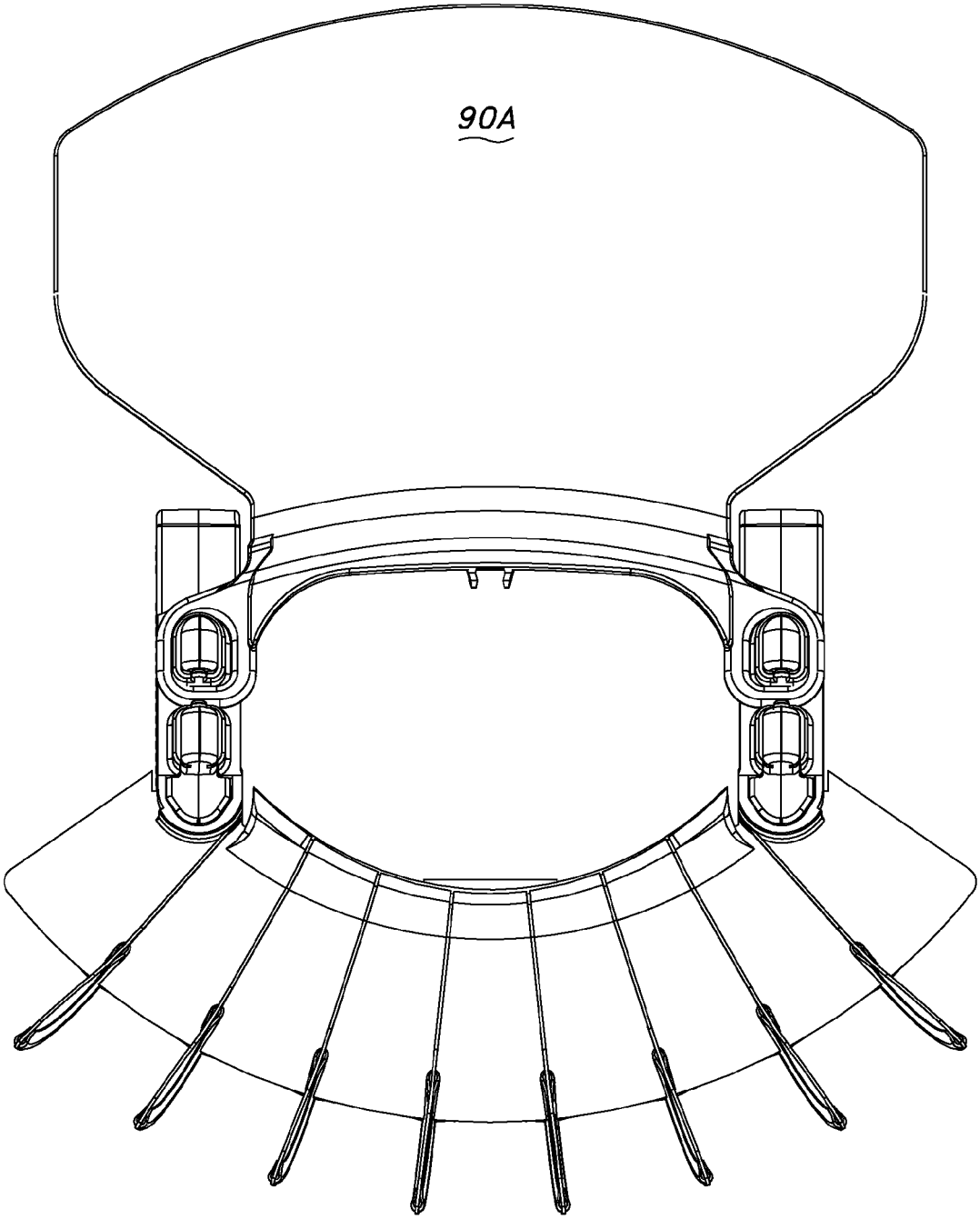
Figure 15:
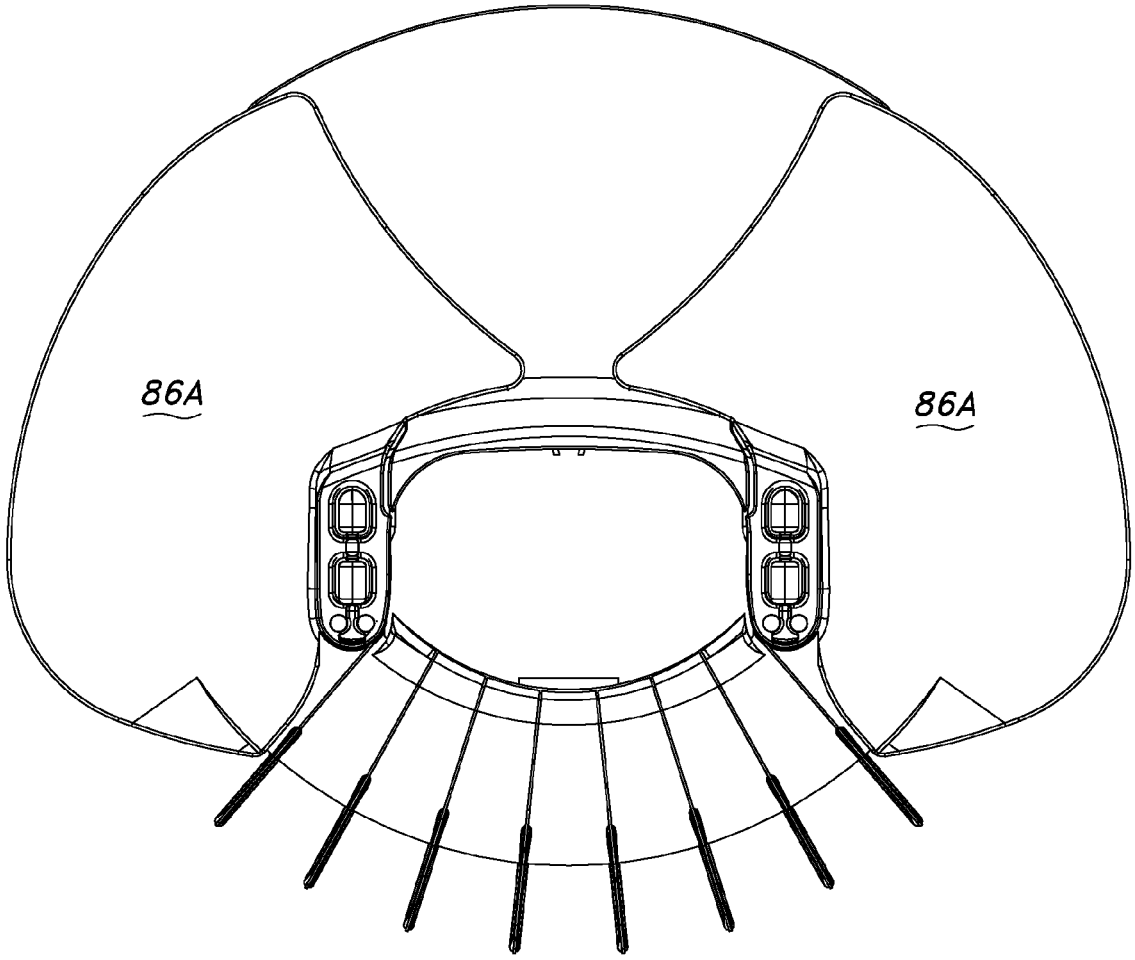
Figure 16:
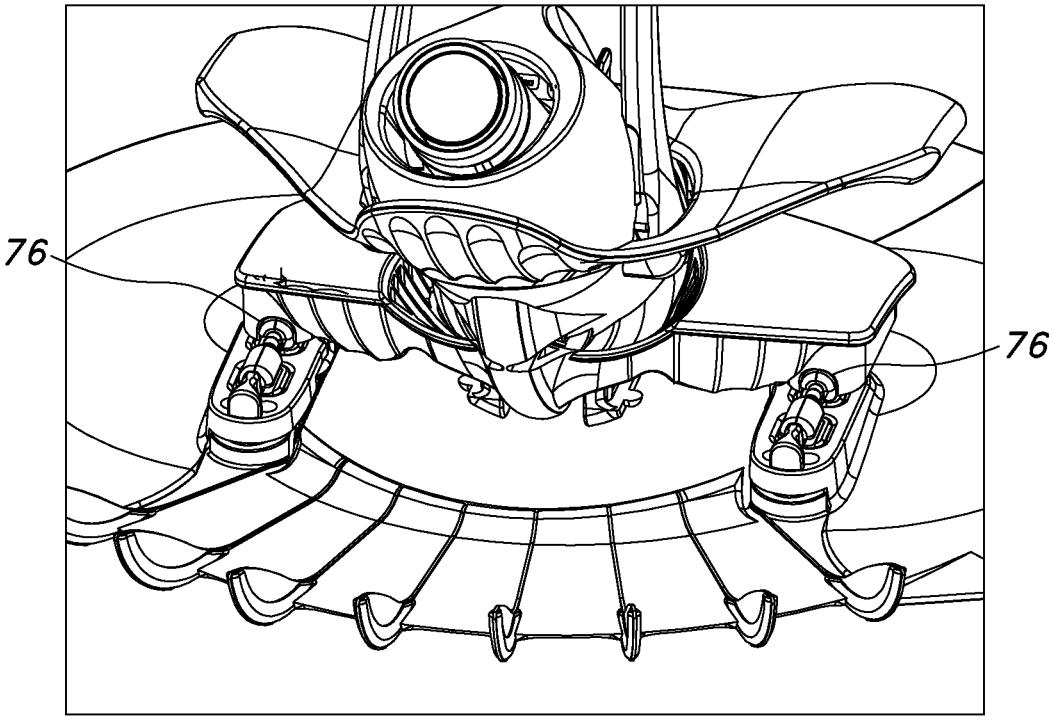
Figure 17:
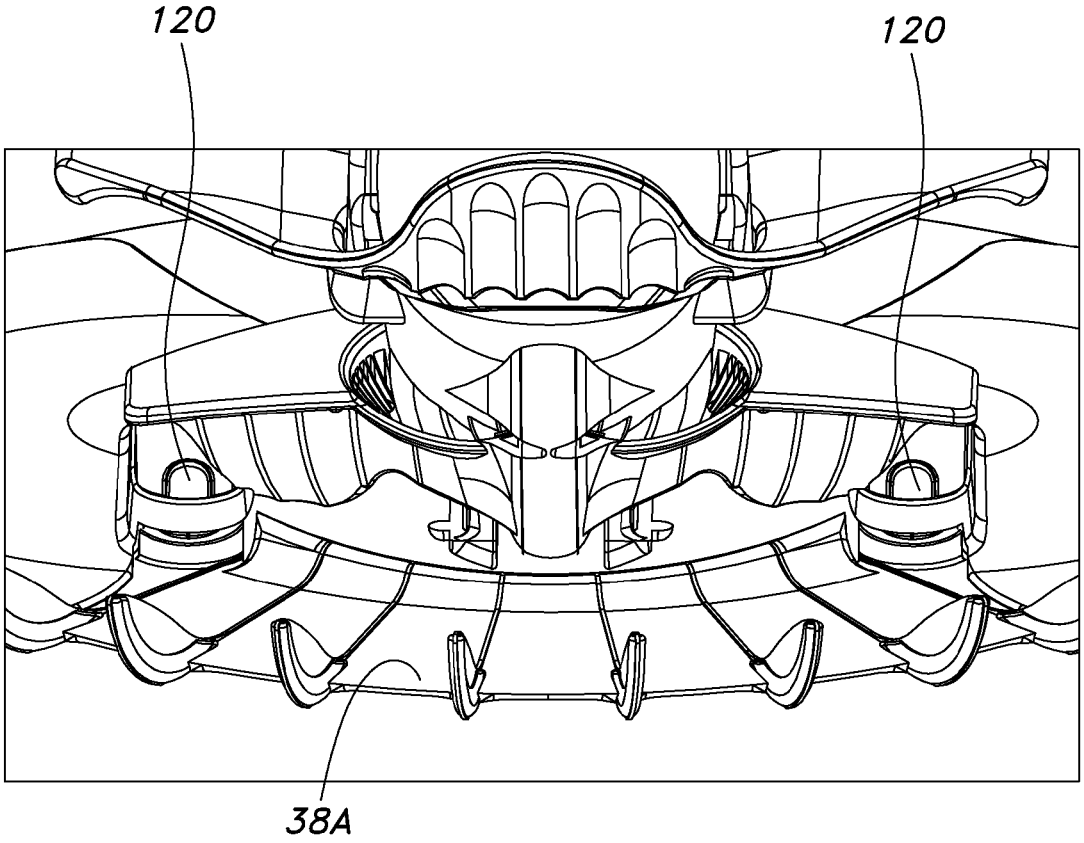
Figure 18:
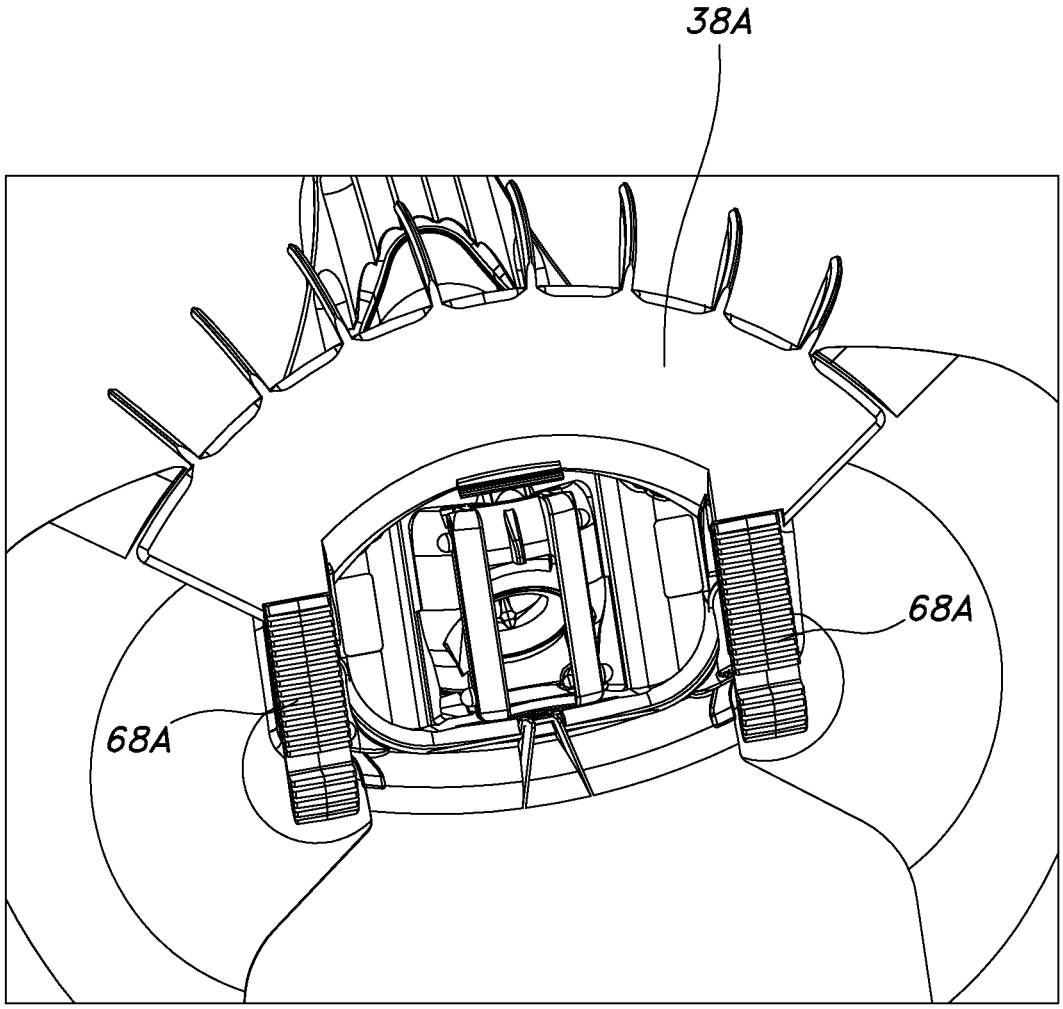

FIGS. 12-18, finally, depict an exemplary connecting scheme for footpad 68A, disc 38A, and apron 34A. As detailed particularly in FIG. 12, each footpad 68A may comprise one or more upstanding columns 114, each containing one or more slots 118 so as to define a head 120. Forward section 78A of disc 38A may include openings designed to receive columns 114, as shown in FIG. 13. Thereafter, rear section 90A of disc 38A may receive selected columns 114 as it is laid over forward section 78A (see FIG. 14), following which one or more mid-sections 86A of disc 38A may overlay rear section 90A (see FIG. 15). The assembly 122 comprising footpads 68A and disc 38A may then be fitted into channels 76 of apron 34 as detailed in FIG. 16. The results of such fitting are shown in FIGS. 17-18, providing a reliable connection scheme for the relevant components.

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

What is claimed is:

1. An automatic swimming pool cleaner comprising:

a. a body adapted to travel in a nominal direction;

b. a flexible disc; and c. means for connecting the flexible disc to the body, the connecting means comprising an apron with a length and a width, and when the length is measured parallel to the nominal direction of travel and the width is measured perpendicular to the nominal direction of travel, the width is substantially greater than the length.

2. An automatic swimming pool cleaner according to claim 1 in which the apron is truncated forward of the body.

3. An automatic swimming pool cleaner according to claim 2 further comprising a footpad having an underside whose bearing surface comprises a first strip of material positioned generally parallel to the nominal direction of travel.

4. An automatic swimming pool cleaner according to claim 3 further comprising a second footpad whose bearing surface comprises a second strip of material positioned generally parallel to the nominal direction of travel.

5. An automatic swimming pool cleaner according to claim 4 in which at least one of the first and second strips of material is serrated.

6. An automatic swimming pool cleaner according to claim 4 in which the body defines a water inlet and the first and second strips of material are disposed symmetrically about the water inlet.

7. A flexible disc for attachment to a body of an automatic swimming pool cleaner, the disc comprising:

a. a first section configured to be forward of the body in use;

b. a second section, of greater flexibility than the first section, configured to be rearward of the body in use; and c. a third section, distinct from the second section and having at least a portion positioned between the first and second sections, of greater flexibility than the first section.

8. A flexible disc according to claim 7 in which the first section comprises an upper surface and a plurality of fins projecting upward therefrom.

9. A flexible disc according to claim 7 in which the first section comprises a lower surface and barbed gripping material protruding downward therefrom.

10. An automatic swimming pool cleaner comprising:

a. a body; and b. a flexible disc attached directly or indirectly to or integrally formed with the body, the flexible disc having an underside and barbed gripping material protruding downward therefrom.

11. An automatic swimming pool cleaner comprising:

a. a body;

b. a flexible disc attached directly or indirectly to or integrally formed with the body, the flexible disc comprising a forward section having a rear edge; and c. means, connected to or integrally formed with the flexible disc at or adjacent the rear edge, for preventing backward movement of the cleaner in use.

12. An automatic swimming pool cleaner according to claim 10 further comprising means, comprising a one-piece, flexible hinge, for facilitating repositioning of the inlet of the valve.

13. A flexible disc for use as part of an automatic swimming pool cleaner comprising a body and a footpad, the disc comprising a first section and a second section distinct from the first section, each of the first and second sections being connected separately in use to either the body or the footpad.

14. A flexible disc according to claim 13 in which the first section is configured to be forward of the body in use, the second section is configured to be rearward of the body in use, and the second section is of greater flexibility than the first section.

15. A flexible disc according to claim 13 further comprising a third section distinct from each of the first and second sections, the third section being connected in use to at least one of the body, the footpad, or the first section.

16. An automatic swimming pool cleaner comprising:

a. a body;

b. a flexible disc; and c. means for directly or indirectly connecting the body and the flexible disc, the connecting means comprising a first column fitted into a first channel.

17. An automatic swimming pool cleaner according to claim 16 in which the connecting means further comprises a second column fitted into a second channel.

18. An automatic swimming pool cleaner according to claim 17 in which the first column contains at least one slot so as to define a head received by the first channel.

19. An automatic swimming pool cleaner according to claim 16 further comprising an apron defining the first channel.

20. An automatic swimming pool cleaner according to claim 19 in which the apron defines a second channel.

21. An automatic swimming pool cleaner according to claim 20 in which the connecting means further comprises a second column fitted into the second channel.

22. An automatic swimming pool cleaner according to claim 16 further comprising a footpad defining the first column.

23. A structure comprising:

a. a flexible disc configured for direct or indirect connection to a body of an automatic swimming pool cleaner; and b. means for directly or indirectly connecting the flexible disc and the body of the automatic swimming pool cleaner, the connecting means comprising a first column configured for fitting into a first channel.

24. A structure according to claim 23 in which the first column is located on a footpad.

25. A flexible disc for an automatic swimming pool cleaner, comprising:

a. a generally planar portion; and b. means, comprising a plurality of openings configured to receive a plurality of columns, for directly or indirectly connecting the disc to a body of an automatic swimming pool cleaner.

* * * * *